US009159171B2

(12) United States Patent
Brands

(10) Patent No.: US 9,159,171 B2
(45) Date of Patent: Oct. 13, 2015

(54) INTEGRATION OF POSITION AND ROAD CHARGING DATA

(75) Inventor: Jan Rene Brands, Nijmegen (NL)

(73) Assignee: Telit Automotive Solutions NV, Leuven (BE)

( * ) Notice: Subject to any disclaimer, the term of this patent is extended or adjusted under 35 U.S.C. 154(b) by 97 days.

(21) Appl. No.: 13/383,716

(22) PCT Filed: Jul. 28, 2010

(86) PCT No.: PCT/IB2010/053423

§ 371 (c)(1),
(2), (4) Date: Jan. 12, 2012

(87) PCT Pub. No.: WO2011/013076

PCT Pub. Date: Feb. 3, 2011

(65) Prior Publication Data

US 2012/0116667 A1 May 10, 2012

(30) Foreign Application Priority Data

Jul. 28, 2009 (EP) ..... 09166606

(51) Int. Cl.
*G07B 15/06* (2011.01)

(52) U.S. Cl.
CPC ..... *G07B 15/06* (2013.01)

(58) Field of Classification Search
CPC ..... G01C 21/3423; G01C 21/3446; G01C 21/3602; G01C 21/3635; G01C 21/3638; G01C 21/3641; G01C 21/366; G01C 21/26; G01C 21/20; G01C 21/00; G01C 21/362; G09B 29/106
USPC ..... 701/117, 469, 532; 705/13, 400, 417; 713/193; 340/539.13, 928, 357.59; 455/414.2, 456.1
See application file for complete search history.

(56) References Cited

U.S. PATENT DOCUMENTS

2003/0189498 A1* 10/2003 Kakihara et al. ..... 340/928
2005/0186965 A1* 8/2005 Pagonis et al. ..... 455/456.1
2005/0251327 A1 11/2005 Ogasawara et al.
2005/0278214 A1* 12/2005 Takida ..... 705/13

(Continued)

FOREIGN PATENT DOCUMENTS

CN 1540286 A 10/2004
CN 1987361 A 6/2007

(Continued)

OTHER PUBLICATIONS

"Chinese Office Action for CN Application No. 2013032601017130 dated Mar. 29, 2013".

(Continued)

*Primary Examiner* — Helal A Algahaim
*Assistant Examiner* — Jelani Smith
(74) *Attorney, Agent, or Firm* — Pearl Cohen Zedek Latzer Baratz LLP

(57) ABSTRACT

A method and apparatus are disclosed wherein positioning data and road charging data depending on a vehicle position may be inserted into a combined data stream. The positioning data and road charging data may be provided with the same protocol type such as a national marine electronics association, NMEA, protocol or NMEA 0183 protocol. The combined data stream therefore comprises a mixed sequence of positioning data protocol messages and road charging data protocol messages.

15 Claims, 2 Drawing Sheets

Figure 1:
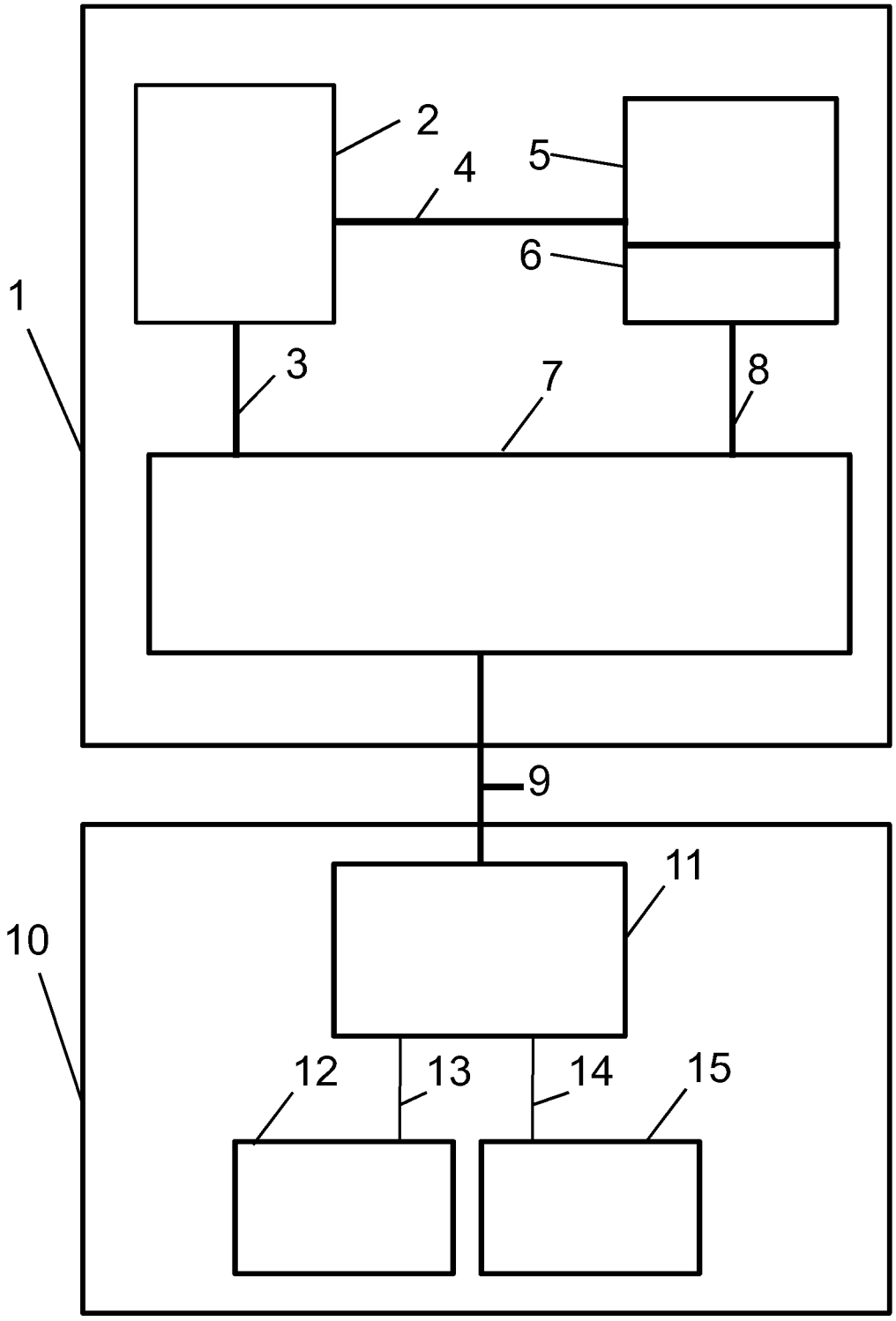

| Original GPS data (NMEA format) | Road charging data | Road charging (NMEA extension) | Integrated data stream (NMEA format) |
|---|---|---|---|
| $GPVTG,0.00,T,,M,0.00,N,0.0,K*60 | | | $GPVTG,0.00,T,,M,0.00,N,0.0,K*60 |
| $GPRMC,083120.278,A,5124.8126,N,00527.4030,E,0.00,0.00,220108,,*07 | | | $GPRMC,083120.278,A,5124.8126,N,00527.4030,E,0.00,0.00,220108,,*07 |
| | Road 1, type 1, rate 5 | $NXRT,ID1,T1,R5*14 | $NXRT,ID1,T1,R5*14 |
| $GPVTG,178.20,T,,M,22.30,N,41.3,K*69 | | | $GPVTG,178.20,T,,M,22.30,N,41.3,K*69 |
| $GPRMC,083328.271,A,5124.3881,N,005 27.1228,E,22.30,178.20,220108,,*3A | | | $GPRMC,083328.271,A,5124.3881,N,00527.1228,E,22.30,178.20,220108,,*3A |
| $GPGGA,083330.270,5124.3776,N,00527.1235,E,1,07,1.3,68.9,M,47.4,M,0.0,0000*4B | | | $GPGGA,083330.270,5124.3776,N,00527.1235,E,1,07,1.3,68.9,M,47.4,M,0.0, 0000*4B |
| | Road 2, type 2, rate 10 | $NXRT,ID2,T2,R10*20 | $NXRT,ID2,T2,R10*20 |
| $GPRMC,083330.270,A,5124.3776,N,005 27.1235,E,15.82,173.47,220108,,*3E | | | $GPRMC,083330.270,A,5124.3776,N,00527.1235,E,15.82,173.47,220108,,*3E |
| $GPVTG,173.47,T,,M,15.82,N,29.3,K*60 | | | $GPVTG,173.47,T,,M,15.82,N,29.3,K*60 |
| etc. | | | |

time

(56) References Cited

U.S. PATENT DOCUMENTS

| | | | | |
|---|---|---|---|---|
| 2006/0235608 | A1* | 10/2006 | Chang | 701/200 |
| 2007/0225912 | A1* | 9/2007 | Grush | 701/213 |
| 2008/0070559 | A1* | 3/2008 | Behr et al. | 455/414.2 |
| 2009/0171772 | A1 | 7/2009 | Petrisor et al. | |
| 2009/0261971 | A1* | 10/2009 | Viegers et al. | 340/539.22 |

FOREIGN PATENT DOCUMENTS

| | | | |
|---|---|---|---|
| CN | 101294817 | A | 10/2008 |
| EP | 0 802 509 | A2 | 10/1997 |
| EP | 1 909 231 | A1 | 4/2008 |
| JP | 2002-024888 | A | 1/2002 |
| JP | 2006-029850 | A | 2/2006 |
| WO | 2008/032075 | A2 | 3/2008 |

OTHER PUBLICATIONS

"Requirement Specification 'Anders Betalen voor Mobiliteit'", Ministerie van Verkeer en Waterstaat, retrieved from the Internet at http://www.verkeerenwaterstaat.nl/kennisplein/page_kennisplein.aspx? DossierURI=tcm:195-15603-4&id=341246, 12 pgs. (Mar. 27, 2006).

"NXP Automotive Telematics On-Board Unit Platform (ATOP )", retrieved from the Internet at http://www.nxp.com/products/automotive/telematics_obu, 2 pgs, (2010).

International Search Report and Written Opinion for Int'l. Patent Appln. No. PCT/IB2010/053423 (Oct. 5, 2010).

"GPS information.net", retrieved from the Internet at http://gpsinformation.net, 8 pgs. (2011).

"NMEA 0183", retrieved from the Internet at http://en.wikipedia.org/wiki/NMEA, 5 pgs (Jan. 4, 2012).

"Road Pricing", retrieved from the Internet at http://en.wikipedia.org/wiki/Road_charging, 13 pgs. (Jan. 10, 2012).

* cited by examiner

| Original GPS data (NMEA format) | Road charging data | Road charging (NMEA extension) | Integrated data stream (NMEA format) |
|---|---|---|---|
| $GPVTG,0.00,T,,M,0.00,N,0.0,K*60 | | | $GPVTG,0.00,T,,M,0.00,N,0.0,K*60 |
| $GPRMC,083120.278,A,5124.8126, N,00527.4030,E,0.00,0.00,220108,,* 07 | | | $GPRMC,083120.278,A,5124.8126, N,00527.4030,E,0.00,0.00,220108,,* 07 |
| | Road 1, type 1, rate 5 | $NXRT,ID1,T1,R5*14 | $NXRT,ID1,T1,R5*14 |
| $GPVTG,178.20,T,,M,22.30,N,41.3,K *69 | | | $GPVTG,178.20,T,,M,22.30,N,41.3,K *69 |
| $GPRMC,083328.271,A,5124.3881, N,005 27.1228,E,22.30,178.20, 220108,,*3A | | | $GPRMC,083328.271,A,5124.3881, N,00527.1228,E,22.30,178.20, 220108,,*3A |
| $GPGGA,083330.270,5124.3776,N,0 0527.1235,E,1,07,1.3,68.9,M,47.4,M, 0.0,0000*4B | | | $GPGGA,083330.270,5124.3776,N,0 0527.1235,E,1,07,1.3,68.9,M,47.4,M, 0.0, 0000*4B |
| | Road 2, type 2, rate 10 | $NXRT,ID2,T2,R10*20 | $NXRT,ID2,T2,R10*20 |
| $GPRMC,083330.270,A,5124.3776, N,005 27.1235,E,15.82, 173.47,220108,,*3E | | | $GPRMC,083330.270,A,5124.3776, N,00527.1235,E,15.82, 173.47,220108,,*3E |
| $GPVTG,173.47,T,,M,15.82,N,29.3,K *60 | | | $GPVTG,173.47,T,,M,15.82,N,29.3,K *60 |
| etc. | | | |

time

Fig. 2

INTEGRATION OF POSITION AND ROAD CHARGING DATA

CROSS-REFERENCE TO RELATED APPLICATIONS

This application is a National Phase Application of PCT International Application No. PCT/IB2010/053423, International Filing Date Jul. 28, 2010, published on Feb. 3, 2011 as International Publication No. WO 2011/013076, which in turn claims priority from European Patent Application No. 09166606.5, filed Jul. 28, 2009, both of which are incorporated herein by reference in their entirety.

FIELD OF THE INVENTION

The present invention generally relates to positioning and road charging.

BACKGROUND OF THE INVENTION

Road charging is an economic concept regarding the various direct charges applied for the use of roads, including those which may vary by time of day, by the specific road, or by the specific vehicle type, being used. Road charging has distinct objectives such as revenue generation, usually for road infrastructure financing, and congestion charging for demand management purposes.

US 2005251327 A1 describes a route calculating system which comprises a device for setting and displaying an optimum route taking road pricing into consideration when displaying the route.

In order to determine where a car is, a satellite navigation system may be used, e.g. the global positioning system (GPS) system or, when it becomes operational, Galileo, or any other positioning system. GPS uses a collection of orbital satellites that transmit signals that enable GPS receivers to determine their current location, the time, and their velocity (including direction).

Some position information receivers such as GPS receivers may provide the calculated navigation information using a standardized protocol such as e.g. the national marine electronics association, NMEA, 0183 protocol. NMEA 0183, or NMEA for short, is a standard for communication between marine electronics devices which uses ASCII strings to format the protocol messages.

Many GPS receiver devices sold on the market (handheld and otherwise) have an output interface (usually RS-232 or USB) that can produce NMEA data. Navigation software typically expects to be able to connect to a GPS receiver device that produces NMEA data to be able to perform the navigation and display the correct map, etc.

SUMMARY OF THE INVENTION

It is an objective of the present invention to provide an apparatus configured to process road charging data with improved functionality.

In accordance with an aspect or embodiment of the invention, an integration of position data such as e.g. GPS positioning data, and of road charging data into a combined data stream, for example an NMEA data stream, is provided.

According to an aspect of the invention, an apparatus is provided which comprises means for combining positioning data and road charging data depending on an e.g. actual vehicle position, into a combined data stream.

Generally, a navigation system may benefit from such road charging information so as to be able to find e.g. cheaper or less busy routes.

Optionally, the positioning data and road charging data are provided in the same protocol type such as a national marine electronics association, NMEA, protocol or NMEA 0183 protocol.

In accordance with one or more of the embodiments the combined data stream comprises a mixed sequence of positioning data protocol messages and road charging data protocol messages.

Optionally, the apparatus comprises a converting means for converting road charging data into the protocol type of the positioning data.

In accordance with one or more of the embodiments the apparatus comprises a road charging calculation means for calculating actual road charging data depending on at least one of the actual vehicle position, time, and traffic condition, etc.

The apparatus may be implemented as, or provided in, an on board unit of an automotive vehicle.

Optionally, the apparatus may comprise a display for displaying at least one of a vehicle position, navigation data, road charging data.

In accordance with one or more of the embodiments the apparatus may comprise at least one of a navigation application, an information platform, and a display.

In accordance with a further aspect, an automotive vehicle may comprise an apparatus as specified above or in the following.

According to another aspect, a method may comprise features of receiving or generating positioning data depending on an actual vehicle position, and combining the positioning data and road charging data depending on vehicle position, into a combined data stream.

In accordance with a further aspect, a computer program product may comprise software codes for carrying out a method as defined above or below.

Optionally, the computer program product may be stored in a storage or data carrier.

An aspect of an implementation of the invention presents a method to integrate a data stream, e.g. an NMEA data stream (containing among others global positioning information) from a GPS receiver and a data stream from a road charging unit into a new data stream, for example in NMEA format.

This combined data stream may be communicated to a car infotainment system, containing route planning navigation software and a display for the user, showing e.g. the road charging costs, navigation data and/or other information such as traffic conditions, time, weather conditions, forecast, etc.

The navigation software can use the road charging data when calculating the optimal route (based on e.g. time, fuel cost and road charging cost) to the driver's destination. The display of the infotainment system can show e.g. the current road charging rate and the accumulated road charging costs of the current trip.

In accordance with one or more embodiments actual or live road charging data are synchronized with positioning information from the positioning system such as GPS. This may be accomplished by inserting the road charging data into the NMEA data stream containing the positioning data.

According to one or more embodiments a road charging unit and a navigation system is provided in the vehicle. In such embodiments a single GPS receiver for both the road charging unit and the navigation system may be provided so as to supply a common positioning information for both systems and thus avoid any deviating positioning information for these systems, and also ensure reduced structural complexity and costs, leading to high reliability.

Further, to keep the complexity of the road charging unit low and the reliability high, as few external interfaces as possible should be connected to other components in the car. In the above or other embodiments a single interface is sufficient for supplying the actual position information. The road charging unit may receive the position information via this interface so as to display current charging data to the driver. No additional wiring or separate display for the road charging unit is needed. The display of the navigation system may additionally be used for displaying the road charging data, providing a user-friendly solution.

Integrating the data streams from the position system such as a GPS receiver, and from the road charging unit provides a variety of advantages. Data streams are synchronized automatically. Only one physical interface is needed to export the data, although two or more interfaces may be present in other embodiments. The position data such as GPS data can be re-used and road charging data can be visualized on an already existing (external) display. In accordance with one or more embodiments, car subsystems (e.g. navigation system, car infotainment system) that wish to obtain both road charging data and positioning information only need to have one physical interface to receive both, reducing the cost and complexity of these subsystems.

Applications that process NMEA data usually look for specific NMEA sentences and ignore data they are not interested in, e.g. a standard navigation application may simply ignore the inserted road charging data. On the other hand, an application interested only in the road charging data can filter out all other NMEA data.

In accordance with one or more of the embodiments live road charging data are made usable, so as to be synchronized with the positioning information from the GPS. In accordance with one or more of the embodiments this is accomplished by inserting the road charging data into the NMEA data stream containing the positioning data.

One or more road charging units and navigation system may be built into the vehicle by the car manufacturers. Using in accordance with one or more of the embodiments a single GPS receiver for both the road charging unit and navigation system is advantageous in avoiding timing or other processing errors stemming from the use of two receivers as well as effective regarding costs and reduced complexity.

Further, to keep the structure and cost of the road charging unit low, it is of advantage in accordance with one or more of the embodiments to use as few external interfaces as possible to connect to other components in the car. One interface will suffice.

The road charging unit may display current charging data to the driver. No additional wiring or a separate display to the road charging unit is necessary as the unit may be provided in the same device of the vehicle.

BRIEF DESCRIPTIONS OF DRAWINGS

These and other aspects of the invention will become apparent from the exemplary embodiments described hereinafter and illustrated in the drawings.

FIG. 1 shows a basic diagram of an embodiment in accordance with an exemplary implementation of the invention, and FIG. 2 schematically shows an example embodiment of a method and data structure in accordance with an exemplary implementation the invention.

DETAILED DESCRIPTION OF EMBODIMENTS

FIG. 1 shows a basic circuit diagram of an embodiment in accordance with the invention which comprises an on-board unit (OBU) or device 1 which is adapted to be built into an automotive vehicle such as a car to implement the road charging functionality. The device 1 comprises a positioning data receiver such as a GPS receiver 2, a road charging calculation unit, device or means 5, a converting means 6 and an integrating or combining device or means 7. The position data receiver 2 is connected to the calculation means 5 via a line or bus 4, and to the integrating device 7 via a line or bus 3. The position data receiver 2 is adapted to output the position data to the road charging calculation means 5 and to the integrating means 7 in form of NMEA data or other protocol type or format such as a serial communications protocol.

To be able to manage demand, the car driver receives feedback on the current and/or future road cost.

The calculation of the road charging cost performed in calculation means 5 may take place using positioning data obtained via line or bus 4 from the positioning data receiver 2 built into the device 1. The calculation means 5 may have access to a data base providing information on the road charges depending on e.g. at least one of the actual position of the vehicle, the actual time, traffic condition such as congestion, etc. The calculation means 5 may comprise the data base as an internal data base or as an external data base accessible to the calculation means 5 in a wireless or wirebound manner. The data base may be updated regularly or depending on changes of the content, etc. The device 1 may be configured to communicate with a back-end system to upload the data collected by device 1 to enable the car owner to be charged for his/her road usage.

The converting means 6 is adapted to format the actual or live road charging cost calculated by means 5 into the same protocol format as the protocol format output by the position data receiver 2, optionally the NMEA or NMEA 0183 format.

The integrating means 7 is adapted to integrate or combine the position data received from the position data receiver 2 and the charging data output from road charging calculation device 5 and converted by the converting means 6 into a combined data stream in form of NMEA data or other protocol form. The respective position data and the timely and positionally related road charging data are positioned close to each other in the resulting data stream so as to maintain the time relationship, and thus synchrony, in the resulting data stream.

The integrating means 7 may be adapted to store the combined data stream in form of NMEA data or other protocol format in a storage, and/or output the combined data stream to a device 10 such as a display or infotainment platform. The device may be arranged at the same vehicle carrying the device 1, and may comprise a control means 11 optionally providing control functions and/or a stream splitting function, a display 12 electrically connected to the device 1 by means of a line or bus 13, and a navigation application 15 electrically connected to the device 1 by means of a line or bus 14. Some or all of the devices 1, 2, 5, 6, 7, 10, 12, 15 may in another embodiment be adapted to communicate with one or more other devices in wireless manner using radio signals.

In the embodiment of FIG. 1, data from the GPS receiver 2 output on line 4, e.g. in NMEA 0183 format, is integrated with data from the road charging calculation device 5 and converted by converting means 6 into the same format, e.g. NMEA 0183. This integration is effected by means 7, by inserting the converted road charging data output on line 8 as NMEA strings into the data stream from the GPS receiver 2 output on line 3.

Therefore, in accordance with one or more of the embodiments, the feature of combining NMEA data streams is presented, comprising connecting to a GPS receiver 2, and using NMEA or live/life road charging data, e.g. on line 8.

In this embodiment solution, positioning and road charging data streams are synchronized automatically. Only one physical interface is sufficient or needed to export the data, for example at the output of means 7 or at line 9. Position data such as GPS data can be re-used and road charging data can be shown on an already existing or an external display such as display 12. The display 12 may be a display of a navigation system or vehicle information system which is configured to display at least one or more or all of navigation data, a map, road usage costs, etc.

One or more embodiments may be applied to or implemented in telematics road-charging devices.

As an example, one or more embodiments may be implemented as, or incorporated into, an on-board platform of an automotive vehicle such as e.g. an automotive telematics on-board platform (ATOP).

FIG. 2 shows an embodiment of a method of generating an integrated data stream in form of a table. The left column of the table of FIG. 2 shows original GPS data messages in the order as output from receiver 2, e.g. on line 3 of FIG. 1, in NMEA format. Each row of FIG. 2 corresponds to a message of the serial protocol such as NMEA 0183 protocol. The second column of FIG. 2 shows an example of actual road charging data as provided e.g. by calculation section 5 of FIG. 1. The third column from the left illustrates the road charging data of the second column but converted, by section 6 of FIG. 1, into messages of the NMEA format. The right-hand column of FIG. 2 shows the integrated data stream as output on line 9 of FIG. 1.

As shown in FIG. 2, the road charging data generated at times corresponding to the third and sixth row of the embodiment of FIG. 2 are converted to NMEA format by adding the NMEA message starting character in form of a dollar sign $, and four or five characters NXRT identifying the source and type of message. The actual road, type and rate parameters of the third row, road 1, type 1, rate 5, are converted to corresponding NMEA parameters ID1, T1, R5. The actual road, type and rate parameters of the sixth row, road 2, type 2, rate 10, are converted to corresponding NMEA parameters ID2, T2, R10.

All data fields are comma-delimited. The asterisk following the last data field character is followed by a two-digit checksum representing a hexadecimal number of the exclusive ORing of all characters between the '$' and '*'.

The converted road charging data are inserted into the NMEA data stream at the time of occurrence in a synchronous manner to the position data of the integrated data stream. The converted road charging data may e.g. be inserted only when a change of the road charge or charging data occurs, or on a repeated basis.

The resulting data stream shown in the right-hand column thus consists of the original GPS data messages and, at the third and sixth position, of the inserted converted road charging data messages.

Other variations to the disclosed embodiments can be understood and effected by those skilled in the art in practicing the claimed invention, from a study of the drawings, the disclosure, and the appended claims.

A single unit or two or more devices may fulfill the functions of several items recited in the description or claims. Measures and features mentioned in the description and claims can be arbitrarily combined.

Each of the features recited above or shown in the drawings or disclosed above in separate embodiments or dependent claims may be advantageously combined with one, two or more of the other features in any arbitrary combination.

While the invention has been illustrated and described in detail in the drawings and foregoing description, such illustration and description are to be considered illustrative or exemplary and not restrictive. The invention is not limited to the disclosed embodiments. For example, it is possible to operate the invention in an embodiment for measuring other signals or parameters.

Other variations to the disclosed embodiments can be understood and effected by those skilled in the art in practicing the claimed invention, from a study of the drawings, the disclosure, and the appended claims. A computer program may be stored or distributed on a suitable medium, such as an optical storage medium or a solid-state medium and may also be distributed in other forms, such as via the Internet or other wired or wireless telecommunication systems.

The excitation and measurement processes, steps, and determinations can be performed by one or several units or devices. For example, the control and measurement can be performed by a single unit of by any other number of different units. The calculations and determinations and/or the control of the system and/or of the device in accordance with the above described features can be implemented as program code means of a computer program and/or as dedicated hardware.

The invention claimed is:

1. An apparatus comprising:

a mobile element for a vehicle which, in operation, receives positioning data formatted according to a protocol output by a position data receiver;

a road charging calculator that, in operation, calculates road charging data depending on at least one of the actual vehicle position, time, and traffic condition; and a convertor which, in operation, converts the road charging data into the protocol type of position data output by the position data receiver;

wherein the mobile element further, in operation, combines the positioning data and the converted road charging data depending on the vehicle position into a combined data stream formatted according to said protocol; and wherein the protocol type is a National Marine Electronics Association, (NMEA), protocol.

2. The apparatus according to claim 1, wherein the combined data stream comprises a mixed sequence of positioning data protocol messages and road charging data protocol messages, and the positioning data protocol messages and the road charging data protocol messages are arranged to maintain a time relationship in the combined data stream.

3. The apparatus according to claim 1, wherein the apparatus is implemented as, or provided in, an on board unit of an automotive vehicle.

4. The apparatus according to claim 1, further comprising a display configured to display at least one of a vehicle position, navigation data, and the road charging data.

5. The apparatus according to claim 1, comprising at least one of a navigation application; an information platform; and a display that is configured to display at least one of a vehicle position, navigation data, and the road charging data.

6. An automotive vehicle comprising apparatus according to claim 1.

7. The apparatus of claim 1, wherein the road charging data are converted into the protocol format by adding a message starting character and at least four characters identifying a source and a type of message.

8. A method implemented in a mobile unit comprising a positioning data receiver and a road charging calculator, the method comprising:

one of receiving and generating positioning data formatted according to a protocol, using the positioning data receiver, depending on an actual vehicle position;

outputting the positioning data from the position data receiver;

providing a convertor in the mobile unit, wherein the converter converts the road charging data into a format according to the protocol of the positioning data output by the position data receiver; and combining the positioning data and the converted road charging data, obtained from the convertor, depending on vehicle position, into a combined data stream; and wherein the positioning data and the road charging data are provided in a National Marine Electronics Association (NMEA) protocol.

9. A method according to claim 8, wherein the method includes at least one of:

arranging positioning data protocol messages and road charging data protocol messages to maintain a time relationship in the combined data stream, the combined data stream comprising a mixed sequence of positioning data protocol messages and road charging data protocol messages, converting road charging data into the protocol type of the positioning data; and calculating actual road charging data depending on at least one of the actual vehicle position, time, and traffic condition.

10. A non-transitory program product, comprising executable software code for carrying out the method according to claim 8.

11. The non-transitory program product according to claim 10, wherein the program product is one of a storage and a data carrier.

12. The method of claim 8, wherein converting the road charging data into the protocol format comprises:

adding a message starting character; and adding at least four characters identifying a source and a type of message.

13. A mobile apparatus, comprising: a positioning data receiver configured to provide positioning data formatted according to a protocol;

a road charging calculator configured to provide road charging data;

a convertor configured to convert the road charging data into the protocol format of positioning data output by the position data receiver; and an element configured to combine the positioning data from the positioning data receiver and the converted road charging data from the convertor, according to a vehicle position, into a combined data stream; and wherein the positioning data and the road charging data are provided in a National Marine Electronics Association (NMEA) protocol.

14. The mobile apparatus according to claim 13, wherein the combined data stream, the positioning data and the road charging data are arranged to maintain a time relationship.

15. The mobile apparatus of claim 13, wherein the road charging data are converted into the protocol format by adding a message starting character and at least four characters identifying a source and a type of message.

* * * * *